US006612471B2

(12) United States Patent
Sellars

(10) Patent No.: US 6,612,471 B2
(45) Date of Patent: Sep. 2, 2003

(54) HOLDING DEVICE THAT FITS INTO POCKETS

(76) Inventor: Christopher Sellars, 2 Country La., Brookville, NY (US) 11545

( * ) Notice: Subject to any disclaimer, the term of this patent is extended or adjusted under 35 U.S.C. 154(b) by 32 days.

(21) Appl. No.: 09/994,196

(22) Filed: Nov. 26, 2001

(65) Prior Publication Data

US 2003/0057241 A1 Mar. 27, 2003

Related U.S. Application Data

(63) Continuation-in-part of application No. 09/965,173, filed on Sep. 27, 2001, now abandoned.

(51) Int. Cl.[7] ..... A45F 5/00

(52) U.S. Cl. ..... 224/230; 224/272; 206/37; 206/38

(58) Field of Search ..... 224/230, 271, 224/272, 587, 678, 680, 682, 684, 901, 929, 930; 206/37, 37.5, 37.6, 38; 211/70.6, 94.01, 162

(56) References Cited

U.S. PATENT DOCUMENTS

| | | | | | |
|---|---|---|---|---|---|
| 1,366,329 | A | | 1/1921 | Bode | |
| 1,833,222 | A | | 11/1931 | Lischeid | |
| 2,508,755 | A | | 5/1950 | Galen | |
| 2,511,105 | A | | 6/1950 | Fenyvessy | |
| 2,603,134 | A | * | 7/1952 | Burnam | 224/185 |
| 2,758,798 | A | * | 8/1956 | Schmidt | 224/245 |
| 3,371,829 | A | | 3/1968 | Phillps | |
| 3,384,277 | A | * | 5/1968 | Hodelka | 224/242 |
| 3,797,717 | A | | 3/1974 | Collins | |
| 4,094,415 | A | * | 6/1978 | Larson | |
| 4,299,344 | A | * | 11/1981 | Yamashita et al. | 224/930 |
| 4,420,078 | A | * | 12/1983 | Belt et al. | 224/236 |
| 4,951,857 | A | * | 8/1990 | Carr | 224/230 |
| 5,031,763 | A | * | 7/1991 | Lynam | 224/230 |
| 5,232,137 | A | * | 8/1993 | Devine | 224/678 |
| 5,484,066 | A | * | 1/1996 | Luisi | 224/901 |
| 5,622,297 | A | * | 4/1997 | Rogers et al. | 224/912 |
| 5,687,856 | A | * | 11/1997 | Kendrena | |

* cited by examiner

*Primary Examiner*—Nathan J. Newhouse
(74) *Attorney, Agent, or Firm*—Collard & Roe, P.C.

(57) ABSTRACT

A device for holding objects in a pocket. This device comprises at least one plate that is made from a rigid material. Coupled to this plate is a patch for fixing the plate inside a user's pants. In addition, there is a clip that is coupled to this plate. This clip is either U-shaped or circular shaped. There can also be an additional clip that is coupled to the at least one plate. In another embodiment, there can be at least one additional plate that is connected to the at least one plate. This at least one additional plate couples to the at least one plate via a series of adjustable tracks having a lock. The tracks allow the device to be adjusted in length.

16 Claims, 7 Drawing Sheets

HOLDING DEVICE THAT FITS INTO POCKETS

CROSS REFERENCE TO PRIOR APPLICATIONS

This application is a continuation in part application of U.S. patent application Ser. No. 09/965,173 filing date Sep. 27, 2001 now abandoned, from which priority is claimed under 35 U.S.C. §120.

BACKGROUND OF THE INVENTION

The invention relates to a holding device that fits into pockets. This holding device is designed to adhere to a user's pockets and hold electronic devices therein such as a heart monitor, an injection device, a beeper, or a cellular telephone, pocket recorders, an ID holder, keys, or a key ring or money clips, battery packs, and microphones.

The following references are known in the art and are listed under U.S. Pat. Nos. 1,366,329; 2,511,105; 2,508,755; 3,371,829; 3,797,717; 1,833,222. All of the references show some form of pocket holding device. However none of the above recited inventions discloses a pocket holder having a patch that holds the pocket holder inside of the pocket. In addition, none of the above cited references show a pocket holder that is adjustable in length. In addition, none of the above recited inventions discloses a pocket holder that has a hole in it.

SUMMARY OF THE INVENTION

The present invention was designed to overcome the problems of the art by presenting a pocket holder that can be adhered inside of a user's pocket and that can also be adjustable in length.

Essentially the invention relates to a pocket holder having a patch or otherwise adhesive backing coupled to a stiff back plate. Coupled to the plate is a front plate that contains a clip. This clip extends out of the front plate and allows a user to clip objects such as an injection device monitor for diabetics, a pump, a cellular telephone, or a beeper to adhere thereto. In addition, there can also be an additional clip coupled to the front plate wherein this additional clip is spaced apart from the first clip. This additional clip is used to also secure the object so that there is limited lateral motion of the object while inside of the user's pocket.

The device can also contain a series of tracks coupled to the front plate at one end. An opposite end of the tracks are coupled to a second plate. There is also a locking mechanism disposed within the tracks to selectively adjust the length of the tracks which also adjusts the length of the device.

BRIEF DESCRIPTION OF THE DRAWINGS

Other objects and features of the present invention will become apparent from the following detailed description considered in connection with the accompanying drawings which disclose several embodiments of the present invention. It should be understood, however, that the drawings are designed for the purpose of illustration only and not as a definition of the limits of the invention.

In the drawings wherein similar reference characters denote similar elements throughout the several views.

DETAILED DESCRIPTION OF THE PREFERRED EMBODIMENT

Figure 1:
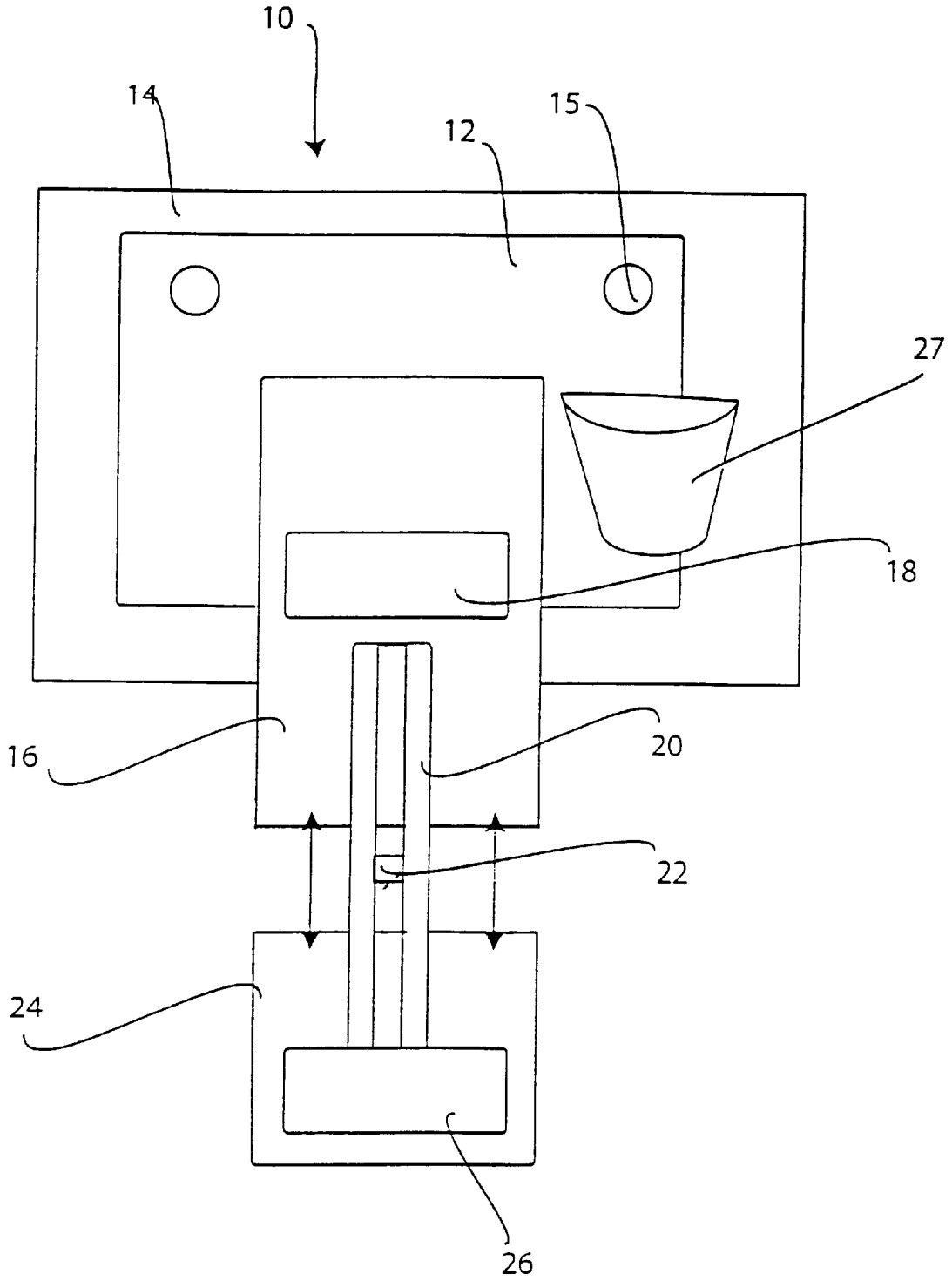
FIG. 1 is a front view of the first embodiment of the invention.
Figure 2:
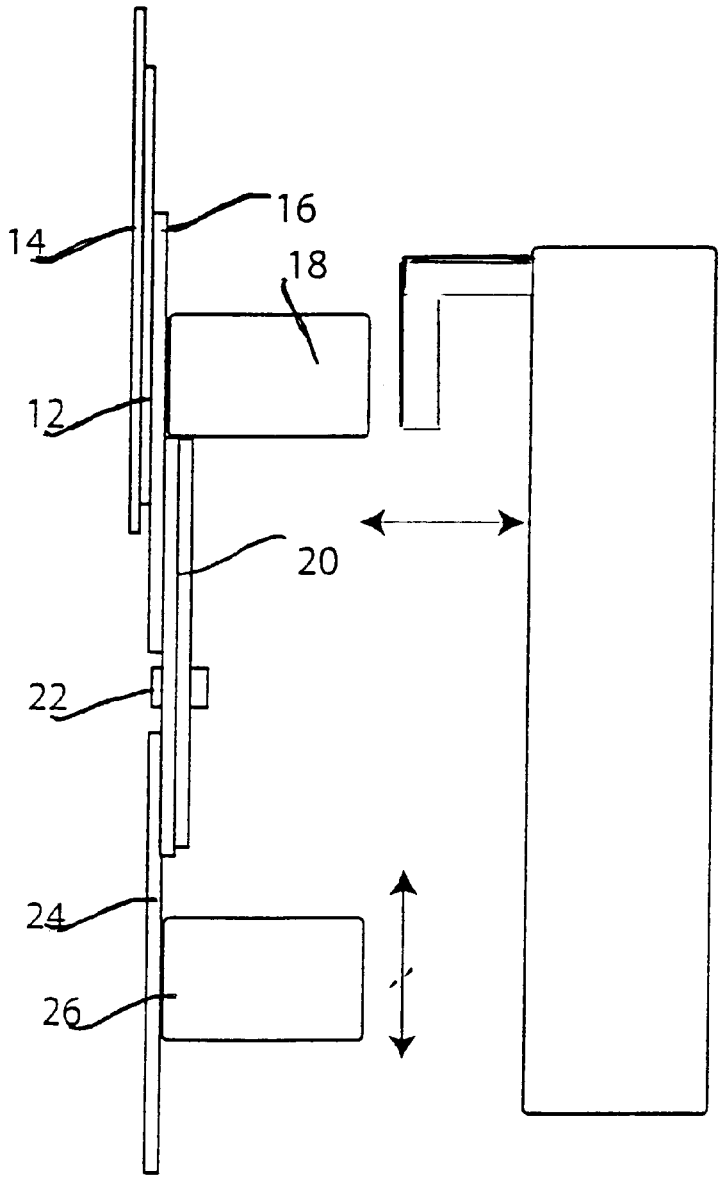
FIG. 2 is a side view of the first embodiment of the invention.

Referring to the drawings, FIG. 1 is a front view and FIG. 2 is a side view of the first embodiment of the invention. As shown, the device 10 includes a back plate 12 coupled to a patch 14. Back plate 12 is substantially stiff and can be made from plastic, metal, leather or any other material that provides a substantially stiff consistency. Patch 14 is essentially a cloth patch that contains a double sided adhesive. A first side of patch 14 adheres to back plate 12 while a second back side of patch 14 adheres to a user's pocket. A hook and loop fastener or other adhesive means can also be used instead of patch 14.

There is also a front plate 16 coupled to back plate 12. Front plate 16 is also made from a resilient or stiff material that is coupled to back plate 12. Extending out from front plate 16 is a clip 18 that can be made from plastic, metal, or rubber. Clip 18 can be either substantially round or U-shaped and is designed to allow an object such as a beeper, cellular telephone, an injection device or a heart monitor to clip thereon.

Coupled to front plate 16 is a track 20 which allows a length adjustment for device 10. Track 20 includes a locking means or lock 22 which allows the length of track 20 to be adjusted. Essentially, track 20 consists of two sets of telescoping, parallel extending tracks wherein a first set of tracks not shown in FIG. 1 slide within a second set of tracks and are selectively locked by compression via lock or locking means 22. Track 20 extends from first front plate 16 to an additional front plate 24 that is coupled to an opposite end of track 20. Additional front plate 24 is made from a resilient material such as a metal plastic or rubber.

In addition, coupled to additional front plate 24 is an additional clip 26. Additional clip 26 is spaced apart parallel from first clip 18 so that an object can fit inside first clip 18 and additional clip 26. There is also a pouch 27, that may be coupled to the device on back plate 12 and patch 14. Pouch 27 may be used to hold a glucose monitor or a similar type device.

Figure 3:
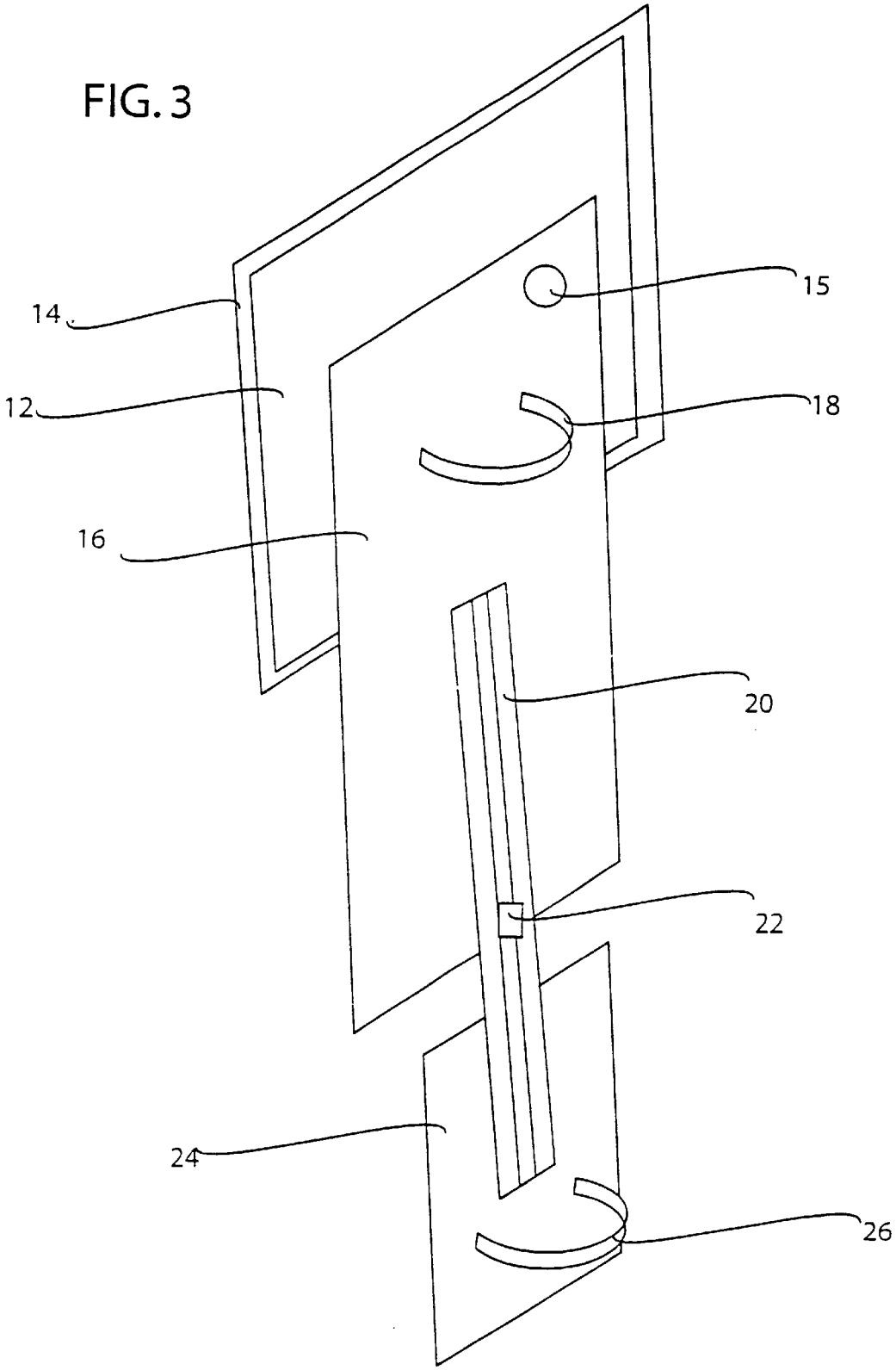
FIG. 3 is a perspective view of the first embodiment of the invention.

FIG. 3 shows a perspective view of the invention whereby these clips 18 and 26 are shown as extending out from front plates 16 and 24 respectively.

Figure 4:
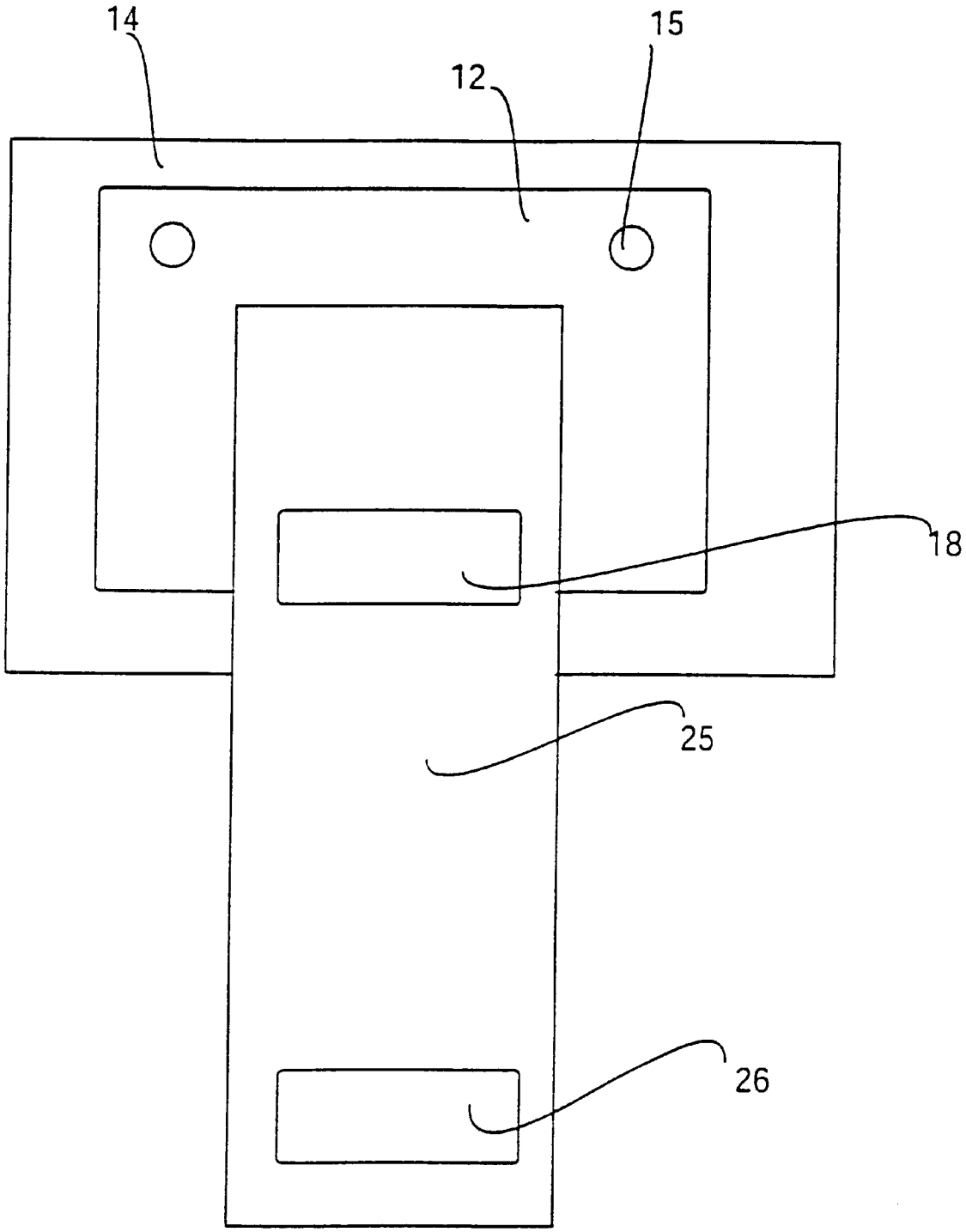
FIG. 4 is a front view of the second embodiment of the invention.

FIG. 4 shows a second embodiment of the invention wherein this device only contains one front plate 25. This front plate is not adjustable in length, however it does contain two different clips 18 and 26 attached thereto. As in the first embodiment, these clips 18 and 26 are spaced apart, parallel from each other.

Figure 5:
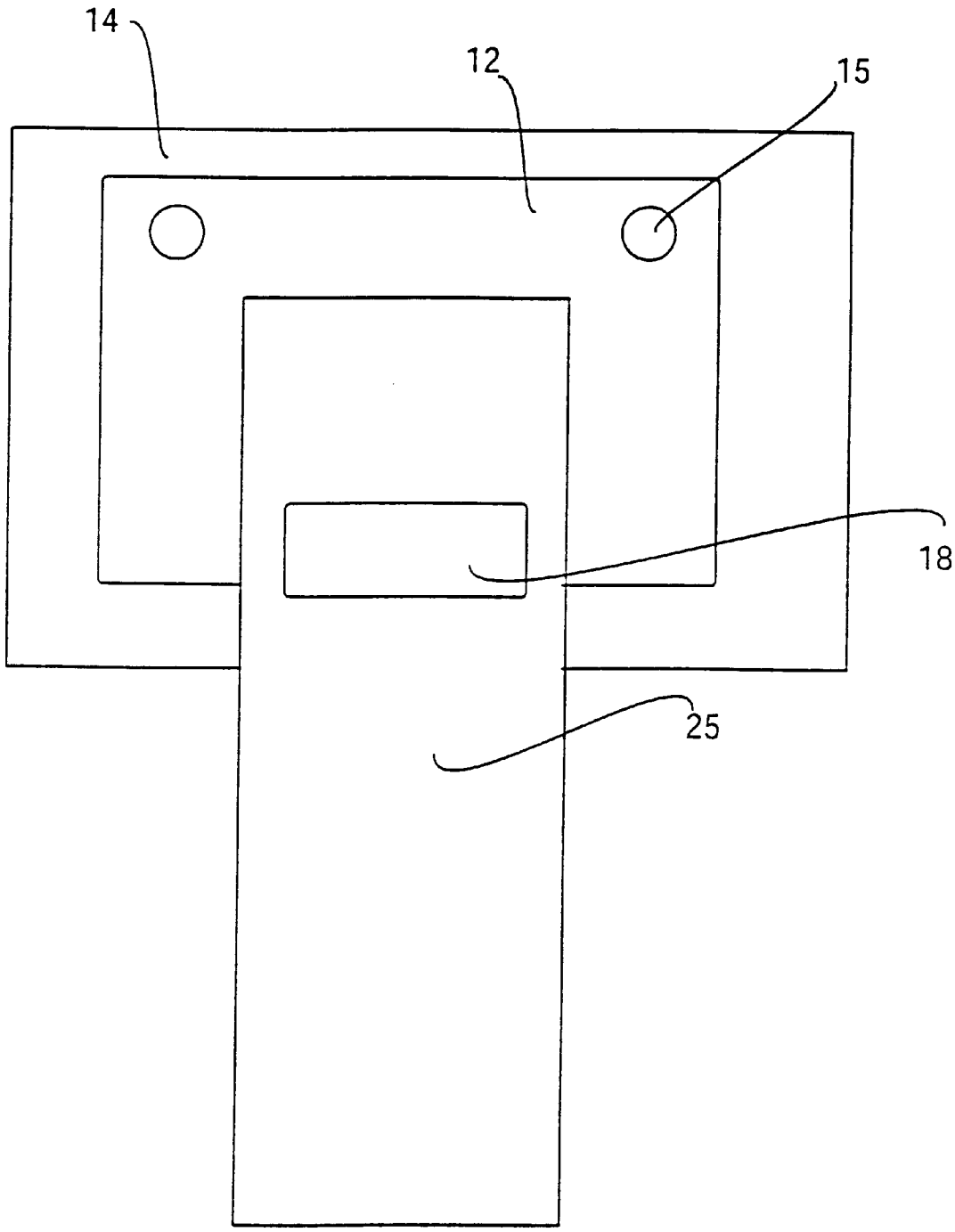
FIG. 5 is a front view of a third embodiment of the invention.

FIG. 5 shows a third embodiment of the invention whereby there is only one front plate 25 and only one clip 18.

This device 10 is designed so that additional objects such as a heart monitor, an injection device such as an insulin injector, a pacemaker, a cellular telephone, an identification document holder, or a beeper can be held to the body.

Figure 6:
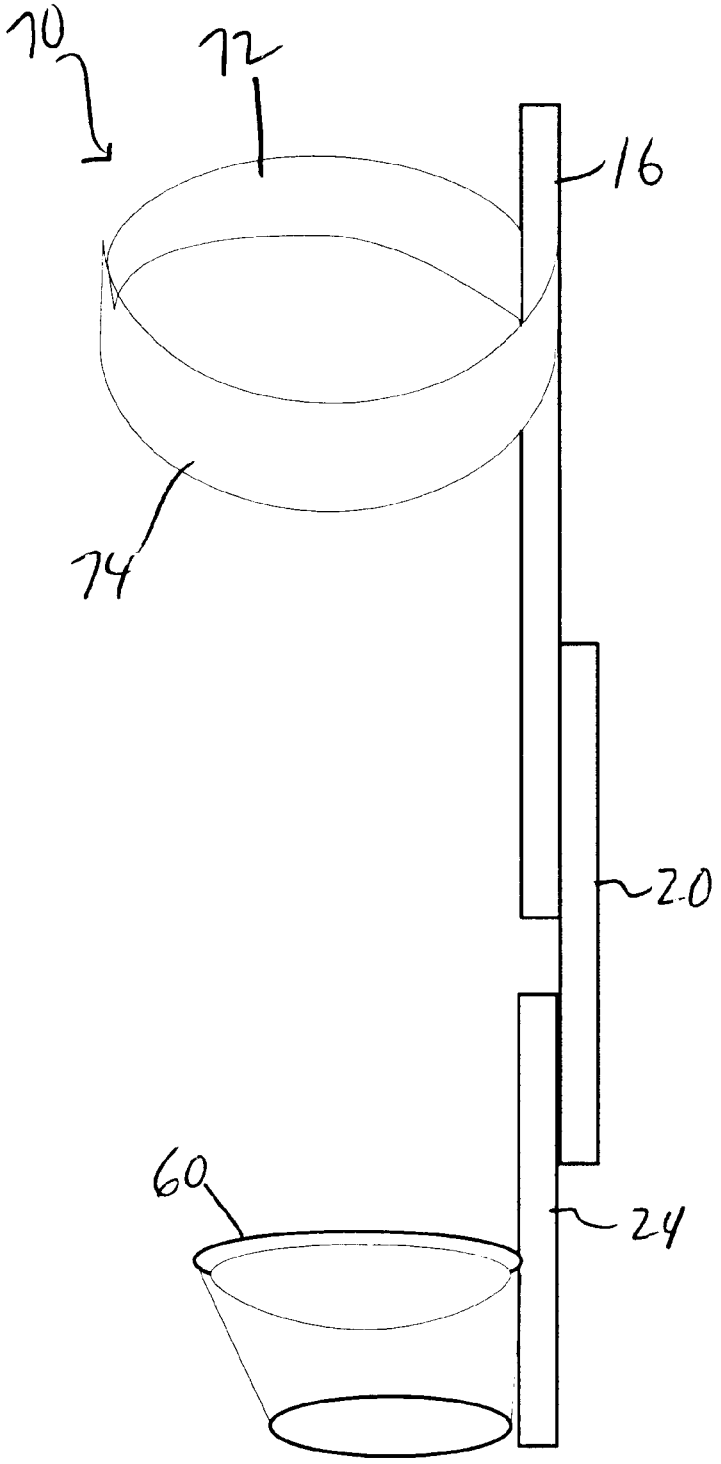
FIG. 6 is a side view of a fourth embodiment of the invention showing different holders for the device.

FIG. 6 is a side view of a fourth embodiment of the invention wherein the top and bottom clips are removed and replaced by a strap 70 comprising a first strap piece 72 and a second strap piece 74. This strap can contain a hook and loop fastener, a clamp closure or a snap closure. Strap 70 is coupled to front plate 16. Strap 70 can be made from a semi-rigid material wherein when this strap is wrapped around a device such as an insulin-injection device, the strap can be used to cover a injection button on this device. In this way this strap could be used to prevent accidental injections from the insulin injection device.

In addition, there is a retaining pouch 60 made from flexible material. This retaining pouch 60 can be made from a flexible cloth or a neoprene type material, or another type of flexible rubber or nylon so that it stretches to fit the article being placed therein.

Figure 7A:
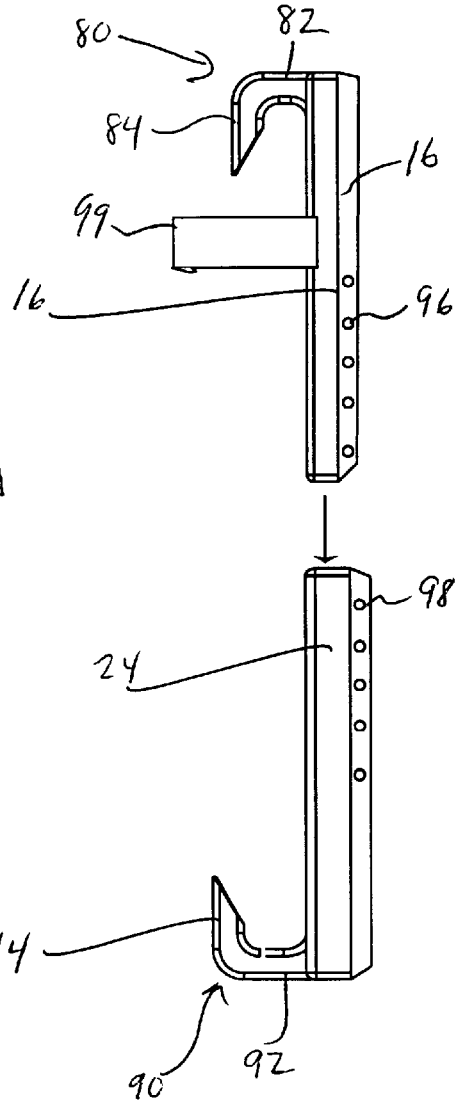
FIG. 7A is a side view of a fifth embodiment of the invention.
Figure 7B:
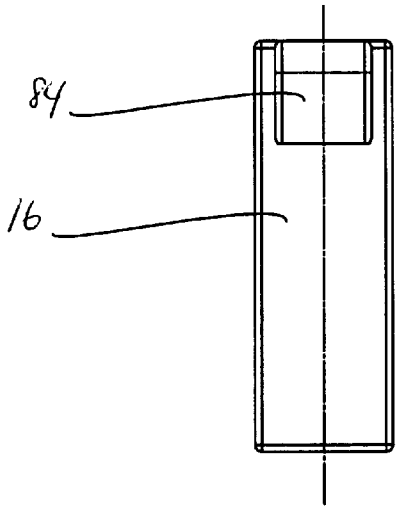
FIG. 7B is a front view of the embodiment in FIG. 7A

FIGS. 7A and 7B show a fifth embodiment of the invention wherein there is shown a device that contains a series of hooks 80 and 90 each coupled to front plates 16 and 24. These hooks 80 and 90 are used to couple to a device such as a insulin injection machine via the clip on the insulin injection machine. Hooks 80 and 90 can either couple directly to the machine or to a clip on the machine. Hook 80 includes a first plate 82 and a second plate 84 while hook 90 includes a first plate 92 and a second plate 94.

With this embodiment, front plate 16 slides within front plate 24 so that these two plates work integral with each other in a telescoping manner. There are also at least one locking detent 96 disposed on front plate 16 which selectively locks front plate 16 within holes 98 on front plate 24.

There is also a guard plate 99 attached to front plate 16, which can be used to block a user's access to an injection button on an insulin injection machine.

Accordingly, while several embodiments of the present invention have been shown and described, it is to be understood that many changes and modifications may be made thereunto without departing from the spirit and scope of the invention as defined in the appended claims.

What is claimed is:

1. A holder for objects that is insertable into a pocket the holder comprising:

a) at least one plate;

b) a patch coupled to said at least one plate, said patch for also coupling said at least one plate to the pocket;

c) at least one clip coupled to said at least one plate;

d) a set of adjustable tracks coupled to said at least one plate;

e) at least one additional plate coupled to said set of adjustable tracks;

f) a lock coupled to said set of adjustable tracks, said lock for allowing said adjustable tracks to adjust in length so that said at least one additional plate can alternately move closer to, or farther away from said at least one plate; and g) at least one additional clip coupled to said at least one additional plate wherein said device can be fixed inside a user's pants or shorts, via said patch and an object such as an electronic device or a pen can be clipped to the device via said at least one clip and said at least one additional clip.

2. The device as in claim 1, wherein said tracks include two sets of tracks wherein a first set of tracks run inside a second set of tracks in a telescoping manner and said lock can selectively lock said two sets of tracks together to adjust a length of the device.

3. The device as in claim 1, wherein said at least one clip and said at least one additional clip is U-shaped.

4. The device as in claim 1, wherein said at least one clip and said at least one additional clip is shaped as a half circle.

5. The device as in claim 1, wherein said at least one plate and said at least one additional plate are made from a rigid material.

6. The device as in claim 1, wherein said at least one plate and said at least one additional plate are made from a flexible material.

7. The device as in claim 1, wherein said flexible material is rubber.

8. The device as in claim 1, further comprising a pouch coupled to said at least one plate and to said patch.

9. The device as in claim 1, wherein said at least one plate has a hole provided therein and said at least one patch has a hole concentric with said hole in said at least one plate so that a wire or feed tube can fit therethrough.

10. A holder for holding objects that is insertable into a pocket, the holder comprising:

a) at least one plate;

b) at least one clip coupled to said at least one plate;

c) a set of adjustable tracks coupled to said at least one plate;

d) at least one additional plate coupled to said set of adjustable tracks;

e) a lock coupled to said set of adjustable tracks, said lock for allowing said adjustable tracks to adjust in length so that said at least one additional plate can alternately move closer to, or farther away from said at least one plate; and f) at least one additional clip coupled to said at least one additional plate wherein said device can be fixed inside a user's pants or shorts, via said patch and an object such as an electronic device or a pen can be clipped to the device via said at least one clip and said at least one additional clip.

11. A holder which can be placed substantially in a clothes pocket and which is for holding an object comprising:

at least one plate;

at least one additional plate;

at least one slidable track coupling said at least one plate and said at least one additional plate together, said slidable track comprising at least one set of telescoping parallel extending tracks;

at least one lock coupled to said at least one slidable track wherein said at least one additional plate can be extended away from said at least one plate using said at least one set of telescoping parallel extending tracks and said at least one lock is for locking said at least one slidable track such that said at least one additional plate can be spaced apart from said at least one plate at different distances.

12. The device as in claim 11, further comprising at least one hook coupled to said at least one plate and at least one additional hook coupled to said at least one additional plate.

13. A holder for holding an object comprising:

at least one plate;

at least one additional plate;

at least one track coupling said at least one plate to said at least one additional plate;

at least one lock coupled to said at least one track wherein said at least one lock is for locking said at least one slidable track such that said at least one additional plate can be spaced apart from said at least one plate and then locked at a selected distance from said at least one plate;

at least one strap coupled to said at least one plate; and at least one retaining pouch coupled to said at least one additional plate wherein the object can slide into the pouch and also be held by said at least one strap so that said object is held close to said at least one plate and said at least one additional plate.

14. The device as in claim 13, wherein said at least one retaining pouch is made from flexible material.

15. The device as in claim 14, wherein said at least one retaining pouch is made from rubber.

16. The device as in claim 15, wherein said at least one retaining pouch is made from neoprene.

* * * * *